US007834270B2

(12) United States Patent
Zhu et al.

(10) Patent No.: US 7,834,270 B2
(45) Date of Patent: Nov. 16, 2010

(54) FLOATING SEGMENTED SHIELD CABLE ASSEMBLY

(75) Inventors: Haoqin Zhu, Winnipeg (CA); Jonathan Li, Winnipeg (CA); John K. Saunders, Winnipeg (CA)

(73) Assignee: IMRIS Inc., Winnipeg, Manitoba (CA)

( * ) Notice: Subject to any disclaimer, the term of this patent is extended or adjusted under 35 U.S.C. 154(b) by 68 days.

(21) Appl. No.: 12/168,200

(22) Filed: Jul. 7, 2008

(65) Prior Publication Data

US 2010/0000780 A1 Jan. 7, 2010

(51) Int. Cl.
*H01B 9/02* (2006.01)

(52) U.S. Cl. ..... 174/105 R

(58) Field of Classification Search ..... 174/102 R, 174/102 SP, 105 R

See application file for complete search history.

(56) References Cited

U.S. PATENT DOCUMENTS 3,870,977 A 3/1975 Peoples et al.
4,129,841 A * 12/1978 Hildebrand et al. ..... 333/237
5,735,278 A 4/1998 Hoult et al.
6,284,971 B1 9/2001 Atalar
7,123,013 B2 10/2006 Gray
7,205,768 B2 4/2007 Schulz
7,294,785 B2 11/2007 Uutela
7,332,676 B2 2/2008 Sparrowhawk
2007/0037419 A1 * 2/2007 Sparrowhawk ..... 439/98

* cited by examiner

*Primary Examiner*—Chau N Nguyen
(74) *Attorney, Agent, or Firm*—Adrian D. Battison; Ade & Company Inc.

(57) ABSTRACT

Signals in an RF field, such as that of an MRI system, are communicated through an inner conductor having an outer shield with a dielectric material therebetween and an outer cable jacket. Current in the shield caused by the RF field from the transmit body coil is reduced by providing a second dielectric material around the shield conductor and a plurality of segmented shield conductor portions formed of non-magnetic braid or wrapped non-magnetic foil tape outside the second dielectric material and inside the jacket at spaced positions along the cable, with the portions being electrically separated from each other and from the shield so that the segmented shield conductor portions act to shield the outer shield conductor to reduce the generation of current thereon while the electrical separation of the segmented shield conductor portions each from the others prevents the generation of a current along the portions.

30 Claims, 7 Drawing Sheets

FLOATING SEGMENTED SHIELD CABLE ASSEMBLY

This invention relates to coaxial cables for use in high RF fields where currents induced in the shield of the cable can have deleterious effects. The invention is particularly applicable to such cable when used in the high RF fields used in Magnetic Resonance Imaging but can relate to other cables. The invention also includes a jacket arrangement which can be applied on to a conventional coaxial cable to obtain the advantageous construction described herein.

BACKGROUND OF THE INVENTION

Many coaxial cables are required to be used in the high RF fields used in MRI. These include primarily the cables to the receive coil array but also other cables that must enter the high RF field such as those used in pacemakers, ECG testing, electrophysiology and EEG monitoring, and Deep Brain Stimulation systems (DBS).

Common mode signals or shield currents on coil cables are often caused by the coil itself or by an external source such as a surrounding transmit body coil during transmit phase. Electromagnetically induced currents by an external source, such as those produced by the body transmit coil, are responsible for the majority of the shield current and therefore heat, on the surface of the cable. These currents, and the resulting heat produced, can cause serious patient heating or burns. Common mode currents also degrade the image quality by affecting coil tuning, coil-to-coil coupling in phased array coils.

In addition the generation of currents in the shield of cables within the coil, especially cables close to or crossing the individual coil loops in a phased array coil, in the magnetic field of the MR scanner can interfere with the creation of the homogenous RF field generated by the transmit body coil. This inhomogeneity of the RF field can generate artifacts within the image obtained.

The advantageous use of coaxial cables having an inner axially oriented elongated conductor separated from an annular electrically conductive shield by a dielectric material has long been known. Such coaxial cables have been used in magnetic resonance imaging, as well as numerous other uses.

Among the important safety concerns related to magnetic resonance imaging technology are the possible burns and excessive heat due to the induced RF currents on the electrical cables. To reduce the risk of such localized heating or burns, the users of the MR scanners are instructed to minimize patient contact with cables. Such contact, however, is unavoidable in many cases such as when using ECG cables, surface coils, or intra-cavity coils.

To minimize localized heating or burns and induced currents on the cables, some commercial MR coils, such as the magnetic resonance coils of GE Medical Systems, for example, use patient safety modules. This design decreases the unbalanced currents on the coaxial cable. In addition to patient safety, this design effects reduction in radiation losses and common mode noise in the coil.

Similar and more serious problems exist for the coils that are inserted inside the body such as endorectal, esophageal, and intravascular RF probes. As these devices are closer to the body, the risk of localized heating or burning a patient is increased. Also, the wavelength of the RF signal in the body is approximately nine times shorter as compared with the wavelength in the air. As a result, current induction on short cables is possible. There remains, therefore, a need for an improved coaxial cable which will perform effectively for its intended purpose while resisting the generation of high currents in the shield which can cause undesired excessive heating or burning of a patient and which can cause interference with the homogeneity of the RF field thus generating artefacts.

Typically the effect of the generation of currents in the shield of the coaxial cable is reduced by using cable traps which are placed in the cable at spaced positions along the length of the cable. These act to reduce the generation of the current.

This is particularly exacerbated where the cable must be very long to accommodate various movements, such as in the system described in U.S. Pat. No. 5,735,278 (Hoult et al) issued Apr. 7, 1998 in which is disclosed a medical procedure where a magnet is movable relative to a patient and relative to other components of the system. The moving magnet system allows intra-operative MRI imaging to occur more easily in neurosurgery patients, and has additional applications for liver, breast, spine and cardiac surgery patients. In this case the high number of cable traps required in the intra-operative MRI coil signal transmission cable in conjunction with the great length of the cable makes the cable particularly unwieldy.

One type of cable traps typically involve an inductor formed from the cable shield braid by wrapping the cable around a helical support so that the shield forms a helical inductor. At one end the copper conductor is electrically connected to the cable shield braid and at the other end one or more capacitors are connected in parallel to the inductor between the copper conductor and the shield to form a tank circuit which acts to attenuate the unwanted shield current on the cable.

In the cable trap arrangement, the shield braid is continuous along the cable and has formed at points along its length the tank circuit defined by the inductor portion of the shield, the copper conductor, and the capacitors.

The cable traps improve the coil performance by eliminating or reducing the shield current along the cable shield. The cable trap is designed to reduce the shield current, but the helical inductor formed from the cable shield of the cable trap also effectively acts as an antenna, to receive RF power from the transmit body coil and contributes unexpected current in the cable.

Experiments have shown that the copper conductor contributed additional heat. This type of cable trap increases the overall coil and cable weight and is not convenient for handling in a surgical setting.

The generation of the shield current is proportional to the geometry of the cable. A larger surface cable generates more shield current than a smaller surface area cable. For example, a longer cable with a larger diameter produces more current than a shorter cable with a smaller diameter.

The generation of the shield current is also proportional to the system RF power. For example, the power from a 3.0 Tesla system will be four times the power from the 1.5 Tesla system, and much higher power for a 7.0 Tesla or higher system. The required number of cable traps for a 3.0 Tesla system will be approximately doubled compared to the 1.5 T system, with closer spacing between cable traps. A 7.0 Tesla or higher system would require even more cable traps with closer spacing.

Also the additional length of the raw cable required, when wrapped helically, to form a cable trap negatively affects the RF chain.

A number of cable designs have previously been proposed as follows:

U.S. Pat. No. 6,284,971 (Atalar) issued to Johns Hopkins University on Sep. 4, 2001 discloses a co-axial cable for probes used in MRI, which has an outer dielectric layer with high dielectric constant, between inner shield portion and a segmented outer shield portion of outer conductor so as to inhibit induced radio frequency current. Thus the arrangement disclosed connects the one end of a segmented shield to the cable shield braid and use the free end of the segmented shield as a ¼ wave cable trap.

U.S. Pat. No. 7,123,013 (Gray) issued to Biophan technologies on Oct. 17, 2006 discloses an arrangement in which a voltage compensation unit reduces the effects of induced voltages upon a device having a single wire line having balanced characteristic impedance. The voltage compensation unit includes a tuneable compensation circuit connected to the wire line which applies supplemental impedance to the wire line and causes the characteristic impedance of the wire line to become unbalanced, thereby reducing the effects of induced voltages.

U.S. Pat. No. 7,205,768 (Schulz) issued to Phillips on Apr. 17, 2007 discloses a lead for use in an MRI device which has an auxiliary electrical device connecting to the lead with sections with inductive coupling element of limited length not equal to integral multiple of the half wavelength.

U.S. Pat. No. 7,294,785 (Uutela) issued to GE Healthcare on Nov. 13, 2007 discloses a lead for use in an MRI device where, in order to eliminate the risk of thermal injuries without compromising the signal-to-noise ratio more than what is required for patient safety, the lead comprises two successive cable elements having different resistance characteristics. The second cable element, which is connected by the first cable element to the patient, has a total resistance increased from a normal high-conductivity resistance value of a patient cable to suppress antenna resonances in the second cable element. The first cable element, which is connected to the electrodes on the skin of the patient, has a total resistance substantially greater than that of the second cable element to prevent electromagnetically induced currents from flowing to the patient and to prevent excessive heating of the cable by electromagnetic induction.

SUMMARY OF THE INVENTION

It is one object of the invention to provide a cable for communicating signals in an RF field where the creation of currents in the cable by the RF field is reduced.

According to one aspect of the invention there is provided a shielded cable comprising:

an inner conductor construction extending axially along the cable and providing electrical connection for transmission of signals between opposite ends of the cable;

an axially extending outer shield conductor disposed in spaced surrounding relationship around the inner conductor construction, the outer shield conductor extending continuously between the opposite ends of the cable for connection to a circuit ground for shielding the inner conductor construction from external fields;

the inner conductor construction being electrically insulated from the outer shield conductor by dielectric material interposed between;

a plurality of braid or solid conductor portions each surrounding the outer shield conductor;

the conductor portions being arranged at axially spaced locations along the cable;

the conductor portions being electrically separated each from the others such that the conductor portions float electrically relative to the other conductor portions;

the conductor portions being electrically separated from the outer shield conductor such that the conductor portions float electrically relative to the outer shield conductor;

and a cable jacket enclosing the conductor portions and the outer shield conductor.

In most cases the conductor portions are annular, that is they fully surround the cable, but this is not an essential requirement provided the portions carry out their shielding action.

In one example the conductor portions are formed from braid but it is often preferred that they are formed from an annular or spiral wrapped non-magnetic metal foil tape since the foil tape avoids the intervening holes between the wires in the braid which can reduce the shielding effect. A combination of braid and solid conductors is also possible.

In one example the conductor portions may be axially spaced, that is the end of one may be spaced from the adjacent end of the next, so as to leave portions of the outer shield conductor which are not covered by the conductor portions. However where a high level of protection is required, the conductor portions may be arranged such that the ends of each are overlapped with corresponding ends of next adjacent conductor portions such that the outer shield conductor is wholly covered by the conductor portions. In this case there will be applied a dielectric material between the outer surface of one portion and the overlapping inner surface of the next adjacent portion to ensure electrical separation. This can be formed by a wrapped tape such as a Teflon™ tape.

In one embodiment there is provided a continuous jacket formed of a dielectric material surrounding the outer shield conductor over which the conductor portions are engaged. However the separation of the conductor portions from the outer shield can be formed by other material such as an annular or spiral wrapped non-magnetic metal foil tape.

In particular in one important feature, the conductor portions are shaped and arranged to reduce heating of the cable in an RF field and particularly the conductor portions are shaped and arranged to reduce heating of the cable in an RF field of a Magnetic Resonance Imaging system to a temperature less than that sufficient to cause injurious burns to human tissue.

Preferably the conductor portions for 1.5 Tesla systems or higher have a length less than a maximum 10 inches and preferably of the order of 0.5 to 2.0 inches which is a practical dimension for manufacture while ensuring the reduction in induced current in the shielding conductor and in the portions themselves to a level which enhances the operation of the cable.

The above defined cable can be formed as an integral construction where the conductor portions are engaged around an intermediate dielectric layer with the cable jacket engaged over the whole construction. However as an alternative the construction can be formed using any existing conventional cable, including coaxial cable enclosed by a cable jacket where the conductor portions are carried on an inner hollow sleeve member which is engaged by sliding over the cable jacket with a second outer jacket which surrounds the inner sleeve member and the conductor portions. This technique avoids the manufacture of a complete cable and allows the use of existing cable constructions as part of the construction, which are inexpensive due to high volume manufacture.

According to a second aspect of the invention therefore there is provided a shielding assembly for use on any existing conventional cable, including coaxial cable to obtain the effect of the shielded cable which is the primary feature of the invention, the shielding assembly comprising:

an inner sleeve member formed of a dielectric material and arranged with a hollow interior defined by an inner surface shaped and arranged to slide over a jacket of the coaxial cable for covering the coaxial cable when installed;

a plurality of conductor portions carried on the inner sleeve member so as to surround the coaxial cable when the inner sleeve member is installed;

the conductor portions each surrounding the inner sleeve member and each having a length less than that of the inner sleeve member;

the conductor portions being arranged at axially spaced locations along the inner sleeve member;

the conductor portions being electrically separated each from the others such that the conductor portions float electrically relative to the other conductor portions;

the conductor portions being electrically separated from the cable such that the conductor portions float electrically relative to the components of the cable;

and a cable jacket enclosing the conductor portions and the inner sleeve member.

This arrangement of the shielding assembly thus is convenient for use with any existing conventional cable, including coaxial cable, to obtain the same effects as described above.

According to a third aspect of the invention there is provided a method of communicating signals in an RF field comprising:

connecting the signals to be communicated to an elongate axially extending inner conductor, or a plurality of conductors;

the inner conductor, or conductors, having an axially extending outer shield conductor disposed in spaced surrounding relationship around the inner conductor;

there being provided a first dielectric material interposed between the inner conductor and the outer shield conductor;

there being provided a cable jacket surrounding the outer shield conductor;

the inner conductor and the outer shield conductor being located in an RF field of sufficient intensity and time period and of a wavelength which would act to generate heat to a temperature sufficient to cause injurious burns to human tissue;

and reducing the heating to a temperature less than that sufficient to cause injurious burns to human tissue by:

providing a second dielectric material located around the outer shield conductor;

and providing a plurality of conductor portions outside the second dielectric material and inside the jacket at spaced positions along the cable with each conductor portion surrounding an outer surface of the second dielectric material, with the conductor portions being axially spaced so as to be electrically separated each from the next and with the conductor portions being electrically separated from the outer shield conductor by the second dielectric material;

where the conductor portions act to shield the outer shield conductor to reduce the heating thereof in the RF field while the electrical separation of the conductor portions each from the next prevents the generation of a current along the portions.

This method can be applied to either a single or multiple conductor cable, and can be used with the second aspect of this invention of the outer jacket surrounding the inner sleeve member and conductor portions.

The above method is particularly applicable where the RF field is generated by an RF transmit coil in a Magnetic Resonance Imaging system. However the method and the cable can be used in to the situation where a high RF field would otherwise generate deleterious currents in the outer shield conductor of a coaxial cable.

For example, where the inner conductor construction and the outer shield conductor are located in an RF field of sufficient intensity and time period and of a wavelength which would act to generate heat to a temperature sufficient to cause injurious burns to human tissue, the plurality of segment shield conductor portions are shaped, arranged and dimensioned relative to the outer shield conductor so as to reduce the heating to a temperature less than that sufficient to cause such burns.

Thus the conductor portions act to shield the outer shield conductor to reduce the heating thereof in the RF field while the electrical separation of the conductor portions each from the others reduces the generation of a current along the portions.

In one particular example, the method is used in a Magnetic Resonance Imaging system for communication of signals from the RF receive coil. In this arrangement, the inner conductor construction includes at least one conductor connected to the RF receive coil of the Magnetic Resonance Imaging system. The plurality of conductor portions are arranged relative to the outer shield conductor so as to reduce currents in the cable from interfering with the homogeneity of the RF transmit field and thereby causing artifacts in the image. The conductor portions act to shield the outer shield conductor to reduce generation of a current in the cable caused by the transmit RF field while the electrical separation of the conductor portions each from the others reduces the generation of a current along the portions.

In another particular example, the method is used where the RF receive coil construction has therein a plurality of receive coil sections. In this example, the inner conductor construction includes a plurality of conductor elements each for communication with a respective one of the individual coil loops in the receive coil.

The conductor elements, either separate single wires or multiple coaxial cables, are combined into the cable connected from the receive coil construction to the MRI system. The conductor elements are branched off at the receive coil into separate paths and each path includes an axially extending outer shield conductor of the path disposed in spaced surrounding relationship around the inner conductor element and there is provided a plurality of the conductor portions as described above surrounding the outer shield conductor.

Preferably the length of each conductor portion is less than $\lambda/4$ where $\lambda$ is the wavelength of the RF field and more preferably the length of each conductor portion is less than $\lambda/8$ where $\lambda$ is the wavelength of the RF field.

The present method thus isolates the segmented shield conductor formed by the conductor portions from the outer cable braid shield with an insulator so that each piece of the segmented shield prevents the continuous current on the cable braid. The segmented shield produces a negligible current; with the smaller the segment, the smaller the current produces.

The floating segmented shield is different from the prior art patents, especially the John Hopkins patent, in that these patents accept the shield current and then try to attenuate or reduce the current by some method of blocking the current flow. The present method prevents the shield current from generating on the cable shield.

Experimental testing, has shown that cable heating can be significantly reduced through the use of the segmented and floating supplemental shielding as described herein. Thus the addition of a floating segment shield outside the primary continuous shield can prevent or reduce the common mode current in the primary shield of the cable by preventing the power from the RF transmit coil from reaching the primary shield. The gaps in the segmented supplemental shield prevent the current flow in the segmented shield.

The floating segmented shield cable design can be used to reduce the heating of a wide variety of cables. Applications include cables used for communication with coils used for catheters, ECG, Deep Brain Stimulation (DBS); and even pacemakers could benefit from this invention to make them MR safe. Any conductive electrical wires, including those with a outer continuous shield can be protected by this invention.

The arrangement described herein can provide some of all of the following features in an MRI coil embodiment:

A greatly reduced shield current in the RX cable caused by the body transmit coil and therefore reduced cable heating and increased patient safety;

Increased overall imaging performance by reduced shield current and increased the image quality by improving coil tuning, coil-to-coil coupling in phased array coils, image uniformity by reducing distortion in the RF $B_1$ field, and image SNR.

Reduce raw cable length, nearly 4 feet shorter based on 3 cable traps for 1.5 T and nearly 8 feet for 3 T, and therefore reduce the weight of the overall coil and cable assembly;

The floating segmented shield concept may be used in conjunction with current coil design;

Increased ease of manufacture due to innovative design;

The cable jacket (or cable hose) material can be selected to be water proof and sterilized for intra-operative coils used in clinical surgery.

This is a cost effective and more efficient method to reduce the shield current on the cable braid, which will increase patient safety in multiple applications.

The arrangement described herein can be used to replace conventional cable traps thus significantly reducing the total weight of the cable.

Alternatively the arrangement can be used with the conventional cable traps located at spaced positions along the shielded cable so that the shielded cable is used in conjunction with the cable traps to further reduce the heating effect and to reduce the number of cable traps required in a predetermined length of the cable.

In this case, the housing of the cable trap itself can be used as another one of the conductor portions where the housing is coated on an inner surface with a non-magnetic conductive material so as to surround that portion of the cable at the cable trap, the conductive material on the housing being electrically separated from the other conductor portions of the cable and from the outer shield conductor within the cable trap.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 6:
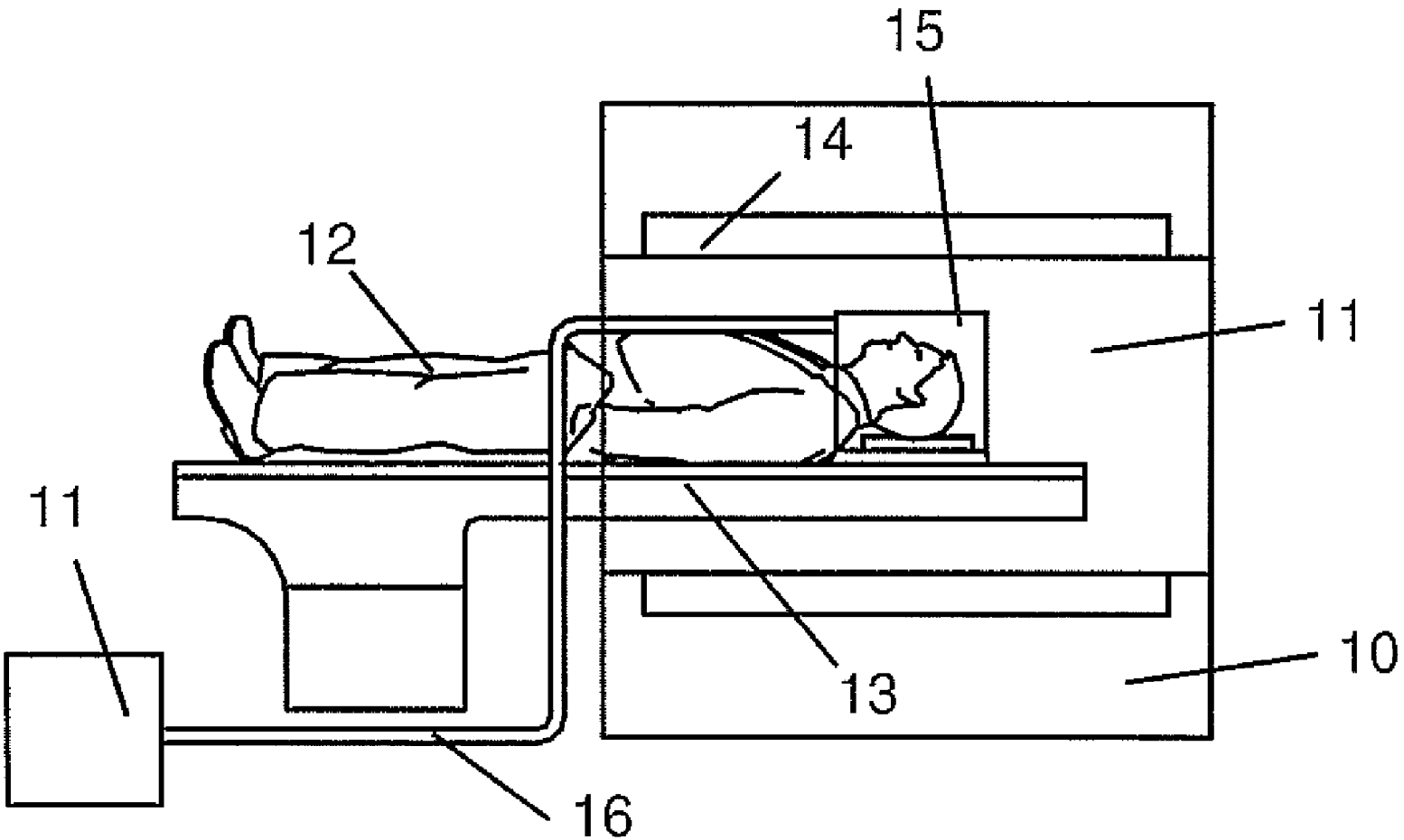
FIG. 6 is a schematic illustration of an MRI system using the cable of FIG. 1.

In FIG. 6 is shown schematically a magnetic resonance imaging system which includes a magnet 10 having a bore 11 into which a patient 12 can be inserted on a patient table 13. The system further includes an RF transmit body coil 14 which generates a RF field within the bore.

The system further includes a receive coil system generally indicated at 15 which is located at the isocenter within the bore and receives signals generated from the human body in conventional manner. A RF control system 17 acts to control the transmit body coil 14 and to receive the signals from the receive coil 15. The cable 16 must be draped into the bore alongside the patient to connect to the received coil assembly within the bore.

Figure 7:
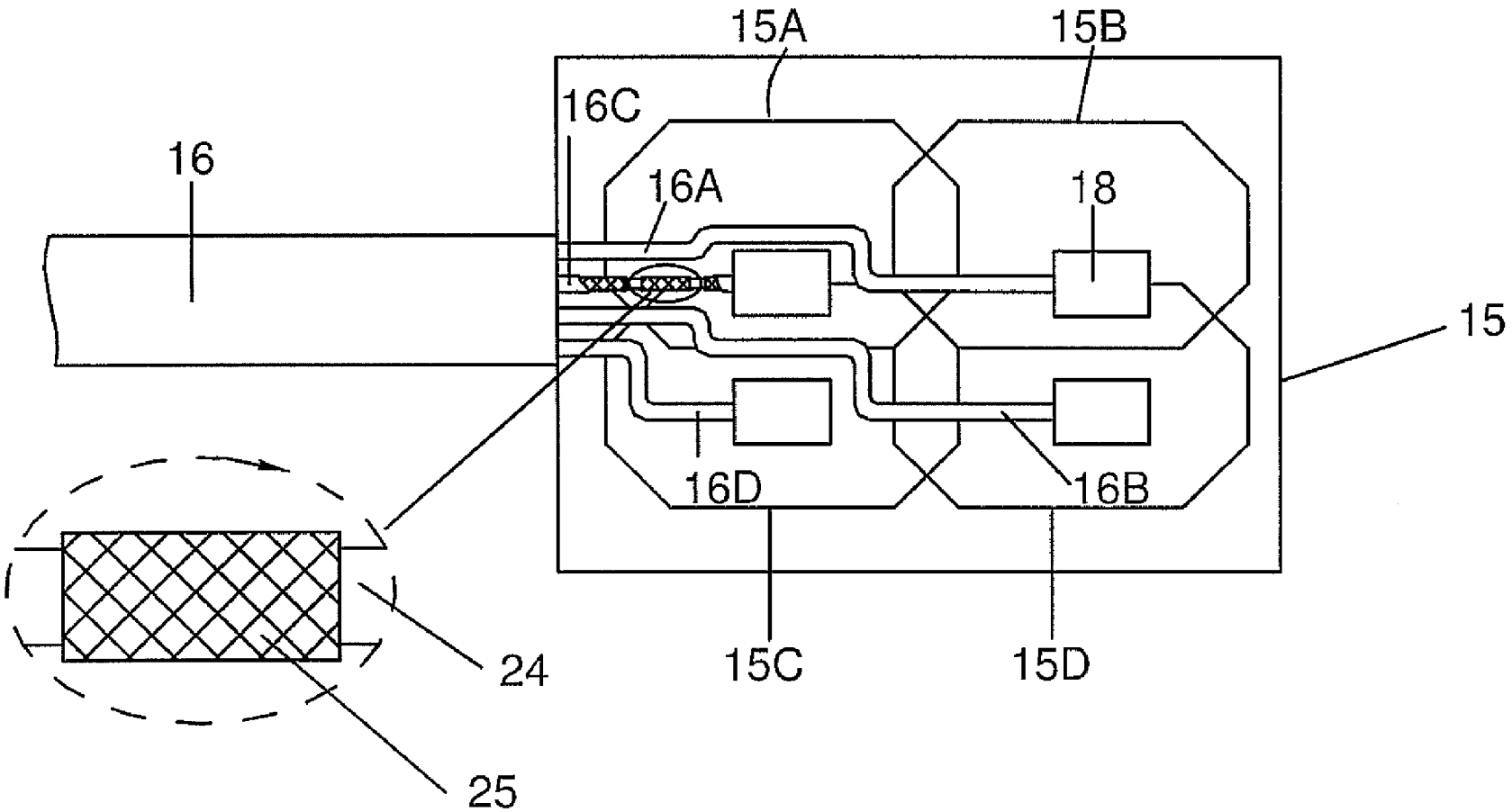
FIG. 7 is a schematic illustration of a receive coil for the MR system of FIG. 6 including a plurality of coil loops.

In FIG. 7 is shown schematically the receive coil assembly 15 which in this arrangement includes a plurality of received coil loops 15A, 15B, 15C and 15D. Each of these loops is connected to a signal transmit coaxial cable and control wire bundle portion 16A, 16B, 16C and 16D so that the received signal from that loop can be transmitted through a larger, multiple coaxial cable and control wire bundle 16 to the RF control system 17.

Thus within the receive coil assembly 15 is located a plurality of conductors which pass through the construction forming the receive coil assembly to various locations within the receive coil assembly for connection to the individual receive coil loops. The arrangement shown is of a very simple nature and it will be appreciated that such receive coil assemblies are often quite complicated involving the connection of overlapping sections so that the wiring of the signal communication cable portions is relatively complex through the structure. Each receive coil loop is connected to a respective preamplifier 18 located as close as possible to the loops and its respective communication cable bundle.

In an arrangement such as that described previously in U.S. Pat. No. 5,735,278, the magnet is moved relative to the patient on the table and this requires in many cases a particularly long cable 16 since the cable is required to accommodate the moving magnet system, and the draping required during surgery.

The particular problem which arises in relation to the above MRI system is that any cable located within the high power RF field generated by the transmit coils can receive induced currents on the external metallic shield of the cable. These are typically of such a magnitude which is sufficient to cause unacceptable heating. In addition the induced currents can be communicated to the receive coil thus generating extraneous RF fields which will interfere with the homogeneity of the transmit field and thus generate artefacts within the image.

This problem is of course well known and the solution typically employed is to provide so called cable traps at spaced positions along the cable. The number of such cable traps required is dependent upon the RF field and so that for a particular RF field there is required a certain spacing between the cable traps. Thus in a situation where the field is increased due to increased power in the MRI system or in a situation where the cable length is increased, the cable carrying the cable traps is increased in weight and difficulty to handle. The cable also must carry a thick insulating layer to protect the patient from close encounter with the heated conductor. All of these requirements significantly increase the weight and structure of the cable to a situation where it becomes unwieldy.

Figure 1:
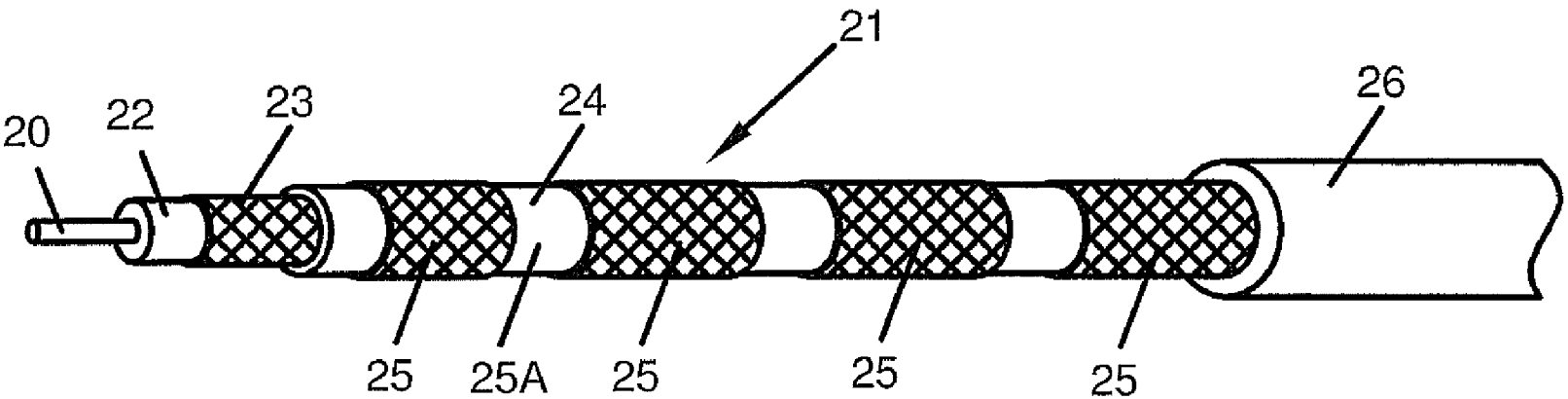
FIG. 1 is a schematic illustration of a communication cable according to the present invention having a single conductor.

In FIG. 1 is shown a construction according to the present invention which can be used to reduce currents induced in the outer conductive shield so as to reduce heating and artefacts as described above. FIG. 1 therefore shows a cable 21 with a single inner conductor 20 surrounded by a dielectric layer 22 and an outer braided, non-magnetic metal shield conductor 23. In addition to these conventional elements is provided an additional cylindrical surrounding dielectric layer 24 which is covered by a series of spaced non-magnetic metal conductor portions 25 at spaced positions along the cable. Around the conductor portions 25 is provided an outer jacket 26 of a conventional construction. The outer jacket 26 may be simply of a dielectric material for providing surrounding protection or it may include a foam insulating layer to reduce heat transfer.

The cylindrical outer shielding conductor 23 is continuous along the cable so that it can be connected to a circuit ground for grounding currents in the conductor 23. This coaxial cable is connected to the coil so that the signals received are transmitted along the cable to the RF system control and are shielded from RF noise effects by the continuous shield 23.

The conductor portion 25 in the embodiment shown in FIG. 1 are spaced so that the end of one conductor portion is axially spaced from the adjacent end of the next adjacent conductor portion leaving a bare area 25A between the conductor portions.

As previously described, the conductor portions act to shield the outer shielding conductor 23 from electromagnetically induced current therealong. Thus the outer conductor portion 25 is electrically separated from the conductor 23 by the layer 24. The outer conductor portion 25 acts as a shield to effectively reduce the current on the braided conductor 23. Also the conductor portions 25 are electrically separated each from the next and each from the others so that any current generated is negligible in each conductor portion and therefore the amount of heat created is reduced.

Figure 2:
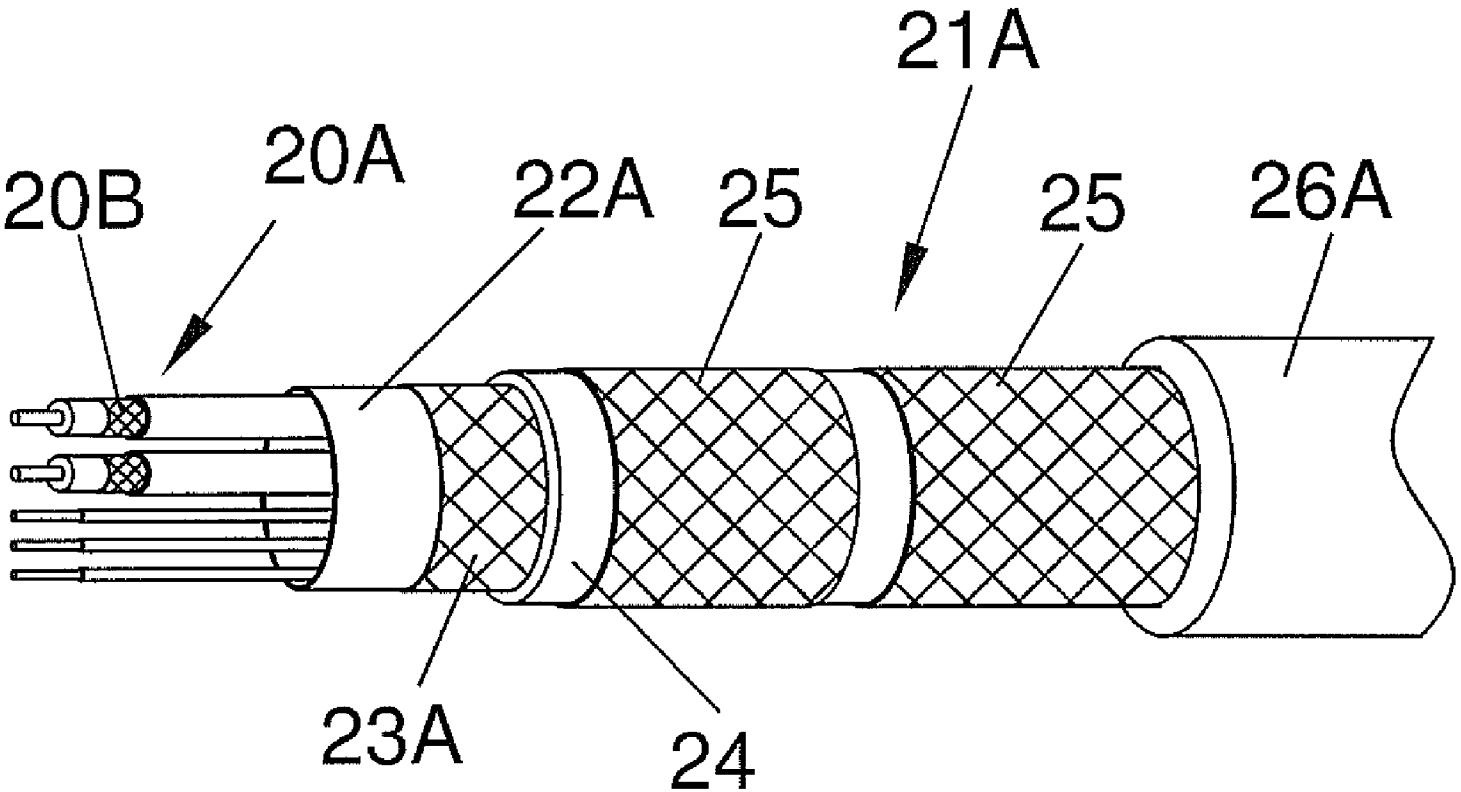
FIG. 2 is a schematic illustration of a communication cable according to the present invention having a plurality of conductors.

In FIG. 2 is shown an embodiment similar to that of FIG. 1 in which the single central conductor 20 is replaced by a plurality 20A of individual conductor elements 20B, comprised of individual coaxial cables and control wires. This of course produces an internal diameter which is larger than that of the cable 21 so that the cable 21A in FIG. 2 includes a larger diameter inner dielectric layer 22A, which is surrounded by the shield 23A, another dielectric layer 24, and by the individual conductor portions 25. A jacket 26A surrounds the structure as previously described.

Figure 3:
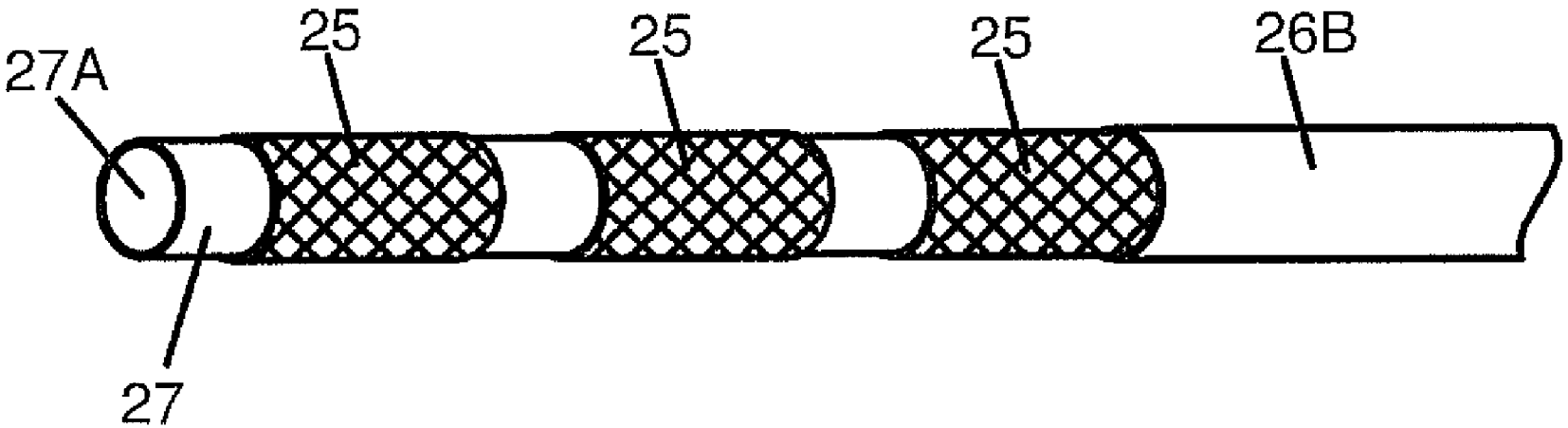
FIG. 3 is a schematic illustration of a shielding sleeve for a communication cable according to the present invention.

In FIG. 3 is shown an alternative arrangement which is used in conjunction with conventional cables utilizing the construction in which one or more individual inner conductors is surrounded by a dielectric layer which in turn is surrounded by the outer shielding layer and an outer jacket. In the embodiment of FIG. 3, is provided an inner sleeve 27 which carries a plurality of conductor portions 25 at spaced positions along its length. The sleeve portion and the conductor portions are covered by an outer jacket 26B. The sleeve portion 27 has an inner surface 27A which can slide over the conventional jacket as a sliding fit so that the inner surface 27A surrounds the cable. This surface may also be coated with heat activated adhesive to permanently affix the sleeve to the jacket of the coaxial cable or wires to be shielded. In this way a conventional cable can be used and can be supplemented in its shielding effect by the provision of the construction shown in FIG. 3 provided by the inner sleeve, the conductor portions and the outer jacket.

Figure 4:
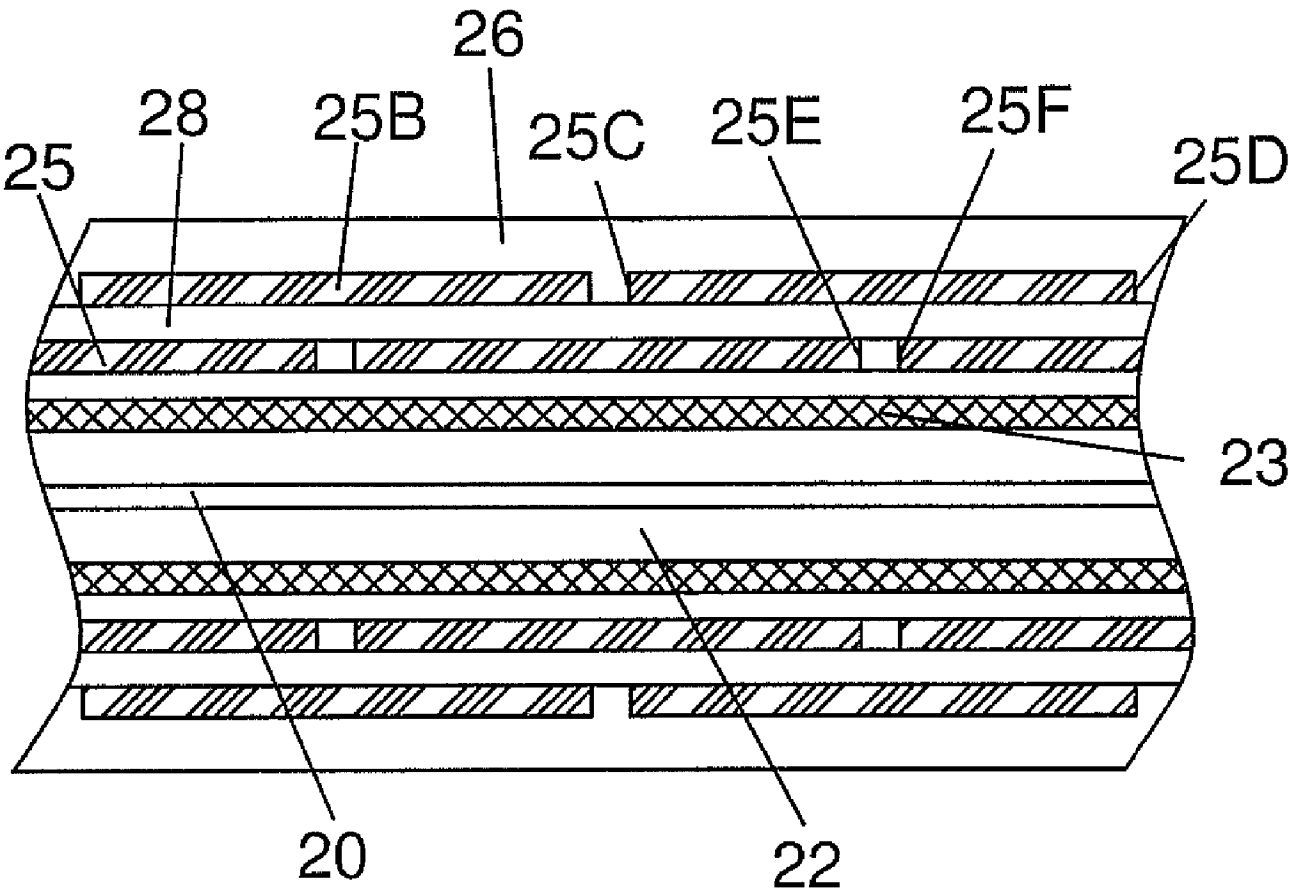
FIG. 4 is a cross sectional view of a communication cable according to the present invention having a single conductor similar to that of FIG. 1 but including overlapping conductor portions.

Turning now to FIG. 4, there is shown in cross section a construction similar to that of FIG. 1 including the central conductor 20, the dielectric layer 22, the outer shield 23 and the jacket 26.

In this embodiment, the conductor portions 25 are supplemented by additional conductor portions 25B which overlap with the conductor portions 25. Thus there are no open or bare portions 25A since the whole of the length of the outer shield in conductor 23 is covered by the conductor portions 25 and 25B. Outside the conductor portions 25 is provided an insulating or dielectric layer 28 which separates the conductor portions 25B from the conductor portions 25 so that all the conductor portions are electrically separated from one another and electrically separated from the common shielding layer 23. Thus as shown each conductor portion 25B has ends 25C and 25D which overlap the ends 25E and 25F of the adjacent conductor portions 25. It will be appreciated that the overlap may be reduced to a very small amount or to where the ends are approximately directly overlying with the intention that the whole of the shielding conductor 23 shielded by the conductor portions while minimizing the amount of conductor portions utilized.

The shielding conductor 23 is typically a braid but can be formed from helically wrapped non-magnetic metal foil. The dielectric layers are typically extruded jackets but also can be formed from a wrapped tape such as Teflon™ tape. The Teflon™ tape has the advantage that it is slippery and hence allows a sliding action where required.

The dielectric layer 24 is shown as a continuous cylindrical sleeve but it will be appreciated that it can be formed in portions since its function is primarily to separate the segmented shield conductor portions 25 from the underlying shielding layer 23 and hence the dielectric layer 24 need be located only underneath the segmented shield conductor portions in the arrangement shown in FIGS. 1, 2 and 3.

Figure 5:
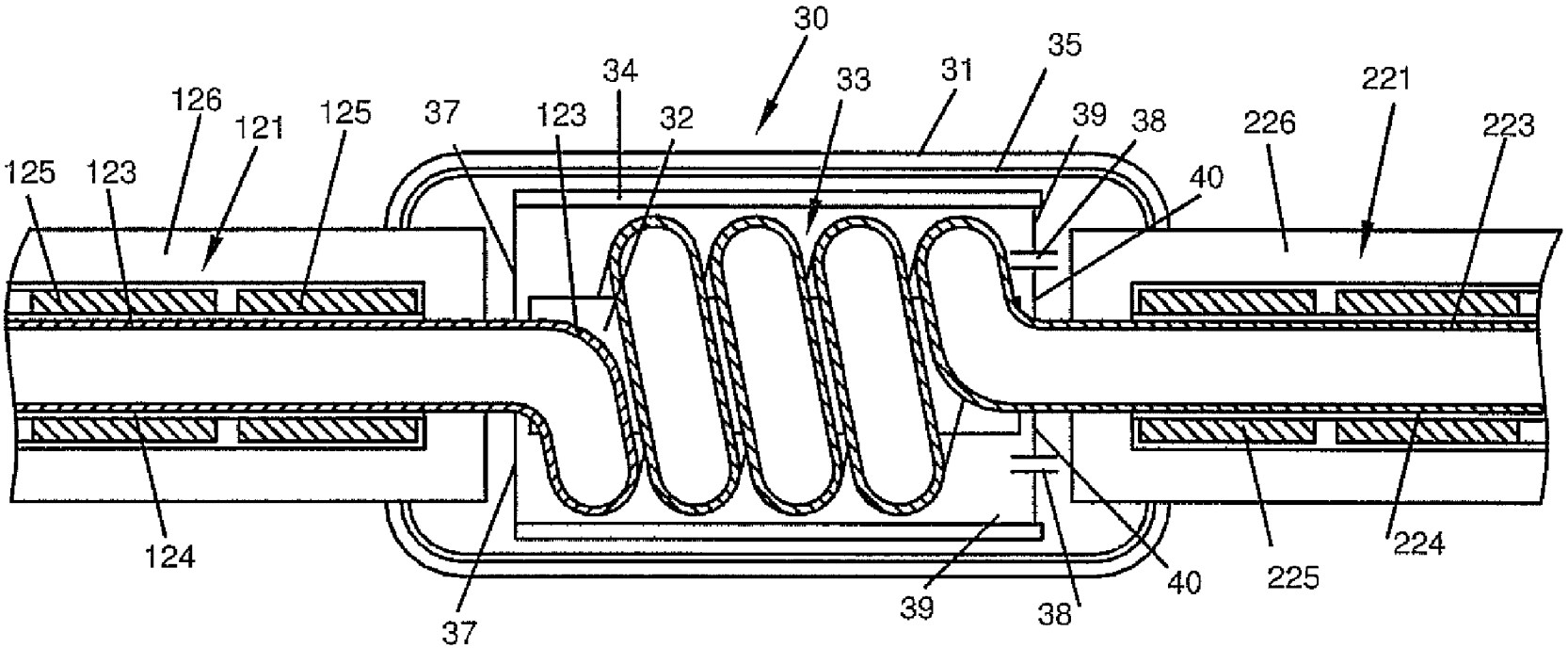
FIG. 5 is a cross sectional view of a communication cable according to the present invention including a cable trap.

Turning now to FIG. 5, there is shown an alternative arrangement which utilizes both the above shielding arrangements and also the conventional cable trap which are used in combination to further reduce the generation of currents in the shielding layer.

Thus in FIG. 5 is shown cable portions 121 and 221 which are of the construction shown in FIG. 1 or 2. Thus the cable portions 121 and 221 include a shielding layer 123 and 223 which is covered by a dielectric layer 124 and 224. Around this is provided the segmented shield conductor portions 125 and 225 together with the jackets 126 and 226. A cable trap 30 is located between these cable portions. The cable trap includes an outer housing 31 which is clamped onto the ends of the jackets 126 and 226 and acts to bridge an area between these jackets. Inside the housing 31 the jacket is stripped away and the portion of the cable defined by the inner conductor and the shield 123 is coiled around a support 32 to form a helical portion 33 of the stripped portion of cable. This helical wrapping of the stripped cable portion forms the outer shield 123 into a helical coil defining an inductor. Around the outside of this inductor is provided a non-magnetic metal conductor 34 which is located inside the housing 31. On the inside of the housing is provided a cylindrical shielding layer 35. This shielding layer can be formed by a spray coating of a non-magnetic metallic substance which is conductive. The shielding layer 35 is maintained separate from the conductor 34 so as to be electrically separated therefrom. In general this is achieved by mounting the conductor on the support 32 so that it is held spaced at a radial separation from the housing 31 and its inside layer 35. The conductor 34 is electrically attached at one end to the shielding layer 123 by a soldered joint 37. At the other end of the conductor is provided a capacitor 38 which is also attached to the conductor and to the shield by a soldered joint 39, 40. In this way the inductor defined by the coiled shielding layer and the capacitor 40 form a tank circuit which acts to define a high impedance to currents tending to formed along the continuous shielding layer 123, 223.

The conductive layer 35 is electrically separated from the shield 123 and electrically separated from the segmented shield conductor portions 125, 225 so that it also acts as another of the conductive portions surrounding that part of the cable trap between the ends of the cable portions 121 and 221.

Turning now to FIG. 7, the cable 16 is of the construction described above formed solely by the construction of FIG. 1, 2, 3 or 4 or including cable traps shown in FIG. 5. In this arrangement the cable is a multiple conductor cable of the type shown in FIG. 2. At the location where the cable enters the receive coil structure 15, the cable shielding material is opened and removed to expose the individual conductor portion 16A, 16B, 16C and 16D. These conductors are then connected to either the pre-amplifiers for each individual coil loop, or directly to the coil loop. Around the outer structure is provided a jacket or a covering to prevent inadvertent electrical connection. Thus each of the cable portions 16A through 16D is itself of the construction shown in FIG. 1 or FIG. 2.

In this way the presence of these cable portions inside the received coil structure avoids the generation of currents on control wires or the shielding conductors of these coaxial cables. While the heating effect is of lesser importance in this area, the presence of currents on the shielding conductor would otherwise provide extraneous RF fields at the coil portions 15A through 15D which would interfere with the RF field from the transmit body coil and thus generate artefacts. Thus the individual cable portions are shielded using the same concept as described herein to reduce the currents in the conductors thereof using the same concepts and arrangements.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. Apparatus for transmitting signals in an RF field comprising:

a source of RF signals to be transmitted;

a circuit ground;

a shielded cable comprising:

an inner conductor construction extending axially along the cable and providing electrical connection for transmission of signals between opposite ends of the cable;

an axially extending outer shield conductor disposed in spaced surrounding relationship around the inner conductor construction, the outer shield conductor extending continuously between the opposite ends of the cable;

the outer shield conductor being connected to the circuit ground;

the outer shield conductor fully enveloping the inner conductor construction so as to shield the inner conductor construction from said RF field;

the inner conductor construction being electrically insulated from the outer shield conductor by dielectric material interposed between;

a plurality of segmented shield conductor portions each surrounding the outer shield conductor and each having a length less than that of the cable;

the segmented shield conductor portions being arranged at locations along the cable;

the segmented shield conductor portions being electrically separated each from the others such that the segmented shield conductor portions float electrically relative to the other segmented shield conductor portions;

the segmented shield conductor portions being electrically separated from the outer shield conductor such that the segmented shield conductor portions float electrically relative to the outer shield conductor;

and a cable jacket enclosing the segmented shield conductor portions and the outer shield conductor.

2. The apparatus according to claim 1 wherein the segmented shield conductor portions are annular.

3. The apparatus according to claim 1 wherein the segmented shield conductor portions are formed from non-magnetic metal braid.

4. The apparatus according to claim 1 wherein the segmented shield conductor portions are formed from a wrapped non-magnetic foil tape.

5. The apparatus according to claim 1 wherein the segmented shield conductor portions are formed from a combination of non-magnetic metal braid and a wrapped non-magnetic foil tape.

6. The apparatus according to claim 1 wherein the segmented shield conductor portions are axially spaced so as to leave portions of the outer shield conductor which are not covered by the segmented shield conductor portions.

7. The apparatus according to claim 1 wherein the segmented shield conductor portions are arranged such that the ends of each are overlapped with corresponding ends of next adjacent segmented shield conductor portions such that the outer shield conductor is wholly covered by the segmented shield conductor portions.

8. The apparatus according to claim 1 wherein the segmented shield conductor portions are each separated from the outer shield conductor by a layer of a dielectric material therebetween.

9. The apparatus according to claim 1 wherein the segmented shield conductor portions are engaged over the cable jacket.

10. The apparatus according to claim 1 wherein the segmented shield conductor portions are carried on a sheath and are covered by an additional outer cable jacket and wherein the sheath with the segmented shield conductor portions and the outer cable jacket thereon is engaged over the cable jacket.

11. The apparatus according to claim 1 wherein the segmented shield conductor portions are shaped and arranged to reduce heating of the cable in an RF field.

12. The apparatus according to claim 1 wherein the segmented shield conductor portions are shaped and arranged to reduce heating of the cable in an RF field of a Magnetic Resonance Imaging system to a temperature less than that sufficient to cause injurious burns to human tissue.

13. The apparatus according to claim 1 wherein the segmented shield conductor portions have a length less than 10 inches.

14. A method of communicating signals in an RF field comprising:

connecting the signals to be communicated to an elongate axially extending inner conductor construction of a communication cable;

providing an axially extending shield conductor of the cable disposed in spaced surrounding relationship around the inner conductor construction, the shield conductor extending continuously between the opposite ends of the cable and being connected to a circuit ground for shielding the inner conductor construction from external fields;

the inner conductor construction being electrically insulated from the shield conductor by dielectric material interposed between;

and providing a cable jacket enclosing the shield conductor;

wherein the inner conductor construction and the outer shield conductor are located in an RF field of sufficient intensity and over time period and of a wavelength which would generate heat therein;

and reducing the amount of heat generated by:

providing a plurality of segmented shield conductor portions, each surrounding the shield conductor and each having a length less than that of the cable;

the segmented shield conductor portions being arranged at locations along the cable;

the segmented shield conductor portions being electrically separated each from the others such that the segmented shield conductor portions float electrically relative to the other segmented shield conductor portions;

and the segmented shield conductor portions being electrically separated from the shield conductor such that the segmented shield conductor portions float electrically relative to the shield conductor of the cable;

where the segmented shield conductor portions act to shield the shield conductor to reduce the heating of the shield conductor in the RF field while the electrical separation of the segmented shield conductor portions each from the others reduces the generation of a current along the segmented shield conductor portions.

15. The method according to claim 14 wherein the RF field is generated by an RF transmit coil in a Magnetic Resonance Imaging system.

16. The method according to claim 15 wherein the inner conductor construction and the outer shield conductor are located in an RF field of sufficient intensity and time period and of a wavelength which would act to generate heat to a temperature sufficient to cause injurious burns to human tissue and wherein the plurality of conductor portions are arranged relative to the segmented shield conductor so as to reduce the heating to a temperature less than that sufficient to cause injurious burns to human tissue.

17. The method according to claim 15 wherein there is provided in the Magnetic Resonance Imaging system an RF receive coil and the inner conductor construction includes at least one conductor connected to the RF receive coil of the Magnetic Resonance Imaging system and wherein the plurality of conductor portions reduce currents in the cable from interfering with the homogeneity of the RF transmit field and thereby causing artifacts in the image.

18. The method according to claim 15 wherein there is provided in the Magnetic Resonance Imaging system an RF receive coil construction having therein a plurality of receive coil loops, wherein the inner conductor construction includes a plurality of conductor elements each for communication with a respective one of the receive coil loops, wherein the conductor elements are combined into the cable connected from the receive coil construction, and wherein the conductor elements are branched off at the receive coil construction into separate paths and each path includes an axially extending outer shield conductor of the path disposed in spaced surrounding relationship around the inner conductor element, the outer shield conductor of the path being connected to a circuit ground for shielding the inner conductor element from external noise, where the inner conductor element is electrically insulated from the outer shield conductor of the path by dielectric material interposed between and there is provided a plurality of segmented shield conductor portions of the path each surrounding the outer shield conductor of the path and each having a length less than that of the path, with the segmented shield conductor portions being arranged at axially spaced locations along the path, the segmented shield conductor portions being electrically separated each from the others such that the segmented shield conductor portions of the path float electrically relative to the other segmented shield conductor portions of the path and the segmented shield conductor portions of the path being electrically separated from the outer shield conductor of the path such that the segmented shield conductor portions of the path float electrically relative to the outer shield conductor of the path.

19. The method according to claim 14 wherein the length of each segmented shield conductor portion is less than $\lambda/4$ where $\lambda$ is the wavelength of the RF field.

20. The method according to claim 14 wherein the length of each segmented shield conductor portion is less than $\lambda/8$ where $\lambda$ is the wavelength of the RF field.

21. The method according to claim 14 wherein the segmented shield conductor portions are annular.

22. The method according to claim 14 wherein the segmented shield conductor portions are formed from non-magnetic metal braid.

23. The method according to claim 14 wherein the segmented shield conductor portions are formed from a wrapped non-magnetic foil tape.

24. The method according to claim 14 wherein the segmented shield conductor portions are formed from a combination of non-magnetic metal braid and non-magnetic foil tape.

25. The method according to claim 14 wherein the segmented shield conductor portions are axially spaced so as to leave portions of the outer shield conductor which are not covered by the segmented shield conductor portions.

26. The method according to claim 14 wherein the segmented shield conductor portions are arranged such that the ends of each are overlapped with corresponding ends of next adjacent segmented shield conductor portions such that the outer shield conductor is wholly covered by the segmented shield conductor portions.

27. The method according to claim 14 wherein the segmented shield conductor portions are each separated from the outer shield conductor by a layer of a dielectric material therebetween.

28. The method according to claim 14 wherein the segmented shield conductor portions are engaged over the cable jacket.

29. The method according to claim 28 wherein the segmented shield conductor portions are carried on a sheath and are covered by an additional outer cable jacket and wherein the sheath with the segmented shield conductor portions and the outer cable jacket thereon is engaged over the cable jacket.

30. The method according to claim 14 wherein the segmented shield conductor portions are engaged underneath the cable jacket.

* * * * *